US005277263A

United States Patent [19]

Amen

[11] Patent Number: 5,277,263

[45] Date of Patent: Jan. 11, 1994

[54] METHOD FOR MEASURING FORMATION FLUIDS IN DRILLING FLUID

[76] Inventor: Randall M. Amen, 19197 Nacogdoches Loop, San Antonio, Tex. 78266

[21] Appl. No.: 865,462

[22] Filed: Apr. 9, 1992

[51] Int. Cl.[5] ..... E21B 49/00

[52] U.S. Cl. ..... 175/42; 73/153

[58] Field of Search ..... 175/42, 50; 73/153, 73/155

[56] References Cited

U.S. PATENT DOCUMENTS

| | | | |
|---|---|---|---|
| 2,214,674 | 11/1940 | Hayward | 255/1 |
| 2,414,246 | 7/1942 | Smith | 73/153 |
| 2,489,180 | 5/1949 | Hayward | 73/153 |
| 2,704,658 | 3/1955 | Gordon | 259/8 |
| 3,155,176 | 11/1964 | Bennett | 175/42 |
| 4,401,169 | 8/1983 | Neshyba | 175/42 |
| 4,447,340 | 5/1984 | Féry | 175/42 X |
| 4,635,735 | 1/1987 | Crownover | 175/48 |
| 4,708,212 | 11/1987 | McAuley et al. | 73/153 |
| 4,765,182 | 8/1988 | Boone | 73/153 |
| 4,807,469 | 2/1989 | Hall | 73/155 |
| 4,887,464 | 12/1989 | Tannenbaum et al. | 73/153 |
| 4,987,960 | 1/1991 | Darlington | 175/42 |

*Primary Examiner*—William P. Neuder

*Attorney, Agent, or Firm*—George C. Limbach

[57] ABSTRACT

In a well drilling operation (10), drilling fluid (70) is used to remove rock cuttings (68) and associated formation fluids released by the drill bit (84) and transport them to the surface. At the surface, a portion of these cuttings and fluids is extracted from the drilling fluid (70) for analyses. The resulting data are used in formation evaluation. This method shows how to determine the concentrations of specific formation fluids in the drilling fluid by adding and maintaining a select foreign substance of controlled concentration to the drilling fluid as a reference fluid (64), and factoring the returned formation fluids by the reference fluid. The method also shows how the technique is used as a means to assure quality control of the measuring system and as a non-disruptive means to measure lag.

19 Claims, 2 Drawing Sheets

METHOD FOR MEASURING FORMATION FLUIDS IN DRILLING FLUID

BACKGROUND—FIELD OF THE INVENTION

This invention relates to evaluating oil and gas wells while drilling, specifically to a method for measuring certain formation fluids in the drilling fluid.

BACKGROUND—DESCRIPTION OF THE PRIOR ART

One of the main objectives in formation evaluation is to determine the composition and volume of producible hydrocarbons in any given formation. Knowing the nature of formation fluids being liberated or produced into the drilling fluid while drilling can be extremely useful in making that evaluation.

In a conventional oil or gas well drilling operation, drilling fluid is pumped from a holding tank on the surface down through the inside of the drillstring through openings in the drill bit. As drilling progresses, the cutting and crushing action of the bit releases rock cuttings and formation fluids from the formation. These liberated rock cuttings and formation fluids become dispersed into the drilling fluid and are carried to the surface in the annular space between the borehole wall and the drillstring by the action of the pump.

At the surface, this mixture is processed so that it can be recirculated as drilling fluid. Typically, some of the rock cuttings are removed by screening and settling, If required, some of the formation fluids are removed. The remaining mixture is returned to the holding tanks, further conditioned chemically and mechanically as needed, and recirculated.

For purposes of formation evaluation, a regular analysis of a portion of the returning mixture is made as it emerges at the surface. The rock cuttings and formation fluids, especially gaseous and liquid hydrocarbons, are evaluated and related to the originating depth. See Hayward, U.S. Pat. No. 2,214,674 (1940).

It is appreciated that freshly cut rock cuttings and associated drilling fluid do not instantaneous arrive at the surface. The delay or "lag" from bit to surface can be expressed in units of time or volume. Several patents show the introduction of "tracers" or "markers" into the drilling fluid to measure lag. Calcium carbide, often used as a tracer, produces acetylene when combined with water. Many other items such as rice, popcorn, and crushed glass are used to better simulate rock cuttings. See U.S. Pat. No. 2,414,246 to Smith (1942), U.S. Pat. No. 3,155,176 to Bennett (1964), U.S. Pat. No. 4,401,169 to Neshyba (1983), U.S. Pat. No. 4,708,212 to McAuley et al. (1987), and U.S. Pat. No. 4,807,469 to Hall (1989).

Normally these tracers are added while the drilling operation is stopped as additional drillpipe is connected to the drillstring. There are occasions when these tracers should not be used because of the possibility of damaging expensive downhole tools.

Historically, "significant" increases of hydrocarbon gases and liquids in the drilling fluid are described using the qualitative terms of a "gas show" or an "oil show". These qualitative terms are subjectively determined by those collecting and interpreting the data.

Considerable effort has gone into developing methods and equipment to evaluate "gas shows" during drilling operations. U.S. Pat. No. 2,489,180 to Hayward (1949) shows how naturally separating saturated gases from the returning drilling fluid can be collected at the surface and submitted to instruments capable of responding to the gases.

Recognizing that some quantity of gas can be entrapped in the drilling fluid, Gordon reveals in U.S. Pat. No. 2,704,658 (1955) how a mud agitator apparatus can be used to liberate at least some of the gases from the drilling fluid. Variations of this device are commonly used today.

As the gases are extracted, they are drawn by vacuum pump to a wellsite laboratory where samples from this gas stream are analyzed for composition and concentration. The extractor efficiency and the rate at which the sample is evacuated from the extractor affect the concentration of gases in the sample.

Gas extraction efficiency and stability vary widely while in operation and from one design to another. Agitator blade design, rotational speed, immersion level in the drilling fluid, volume of fluid processed, mud temperature, resident time in the extractor, sample evacuation rate and other factors all contribute to variable extraction efficiency and stability. Understanding this to be a problem, Tannenbaum et al, U.S. Pat. No. 4,887,464 (1989) shows the use of a rotating disk extractor in an effort to gain control over this variation.

In addition to extraction efficiency, several other complex and dynamic variables affect the relationship between fluid measurements made at the surface to fluid content in the formation. These variables include drilling parameters, sensing techniques, downhole differential pressures, fluid properties, sampling systems, and others. U.S. Pat. No. 4,635,735 to Crownover (1987), U.S. Pat. No. 4,765,182 to Boone (1988), and U.S. Pat. No. 4,887,464 to Tannenbaum et al (1989) all find it necessary to precisely monitor several parameters and factor them to the measured portion of formation fluids at the surface in order to relate them to that in the formation.

In short, not all of the parameters affecting gas extraction and measurements are controlled or monitored. Gas-in-mud data is often inaccurate, inconsistent, and misleading making surface gas measurements of limited use in formation evaluation. Consequently, productive zones are missed and resources are wasted testing nonproductive zones.

OBJECTS AND ADVANTAGES

Several objects and advantages of my invention are:

(a) to provide a method to measure formation fluids in drilling fluid without having to precisely measure gas extractor efficiency;

(b) to provide a method to measure formation fluids in drilling fluid without having to precisely measure the amount or rate of drilling fluid being processed in the extractor;

(c) to provide a method to measure formation fluids in drilling fluid without having to precisely measure the evacuation rate of the separated gases from the gas extractor;

(d) to use the results of gas-in-mud data with drill rate and pump rate to calculate gas-in-formation; formation;

(e) to provide a method of quality control to assure that the gas extraction and detection system is properly functioning.

(f) to provide a method to introduce a lag tracer to the drilling fluid without having to stop drilling operations; and (g) to provide a method to introduce a lag tracer to the drilling fluid without damaging downhole tools.

Further objects and advantages are that this method simplifies a complex measurement and can be easily understood. It can be implemented using existing hardware with minimal additional costs.

Accordingly, the following describes my method formation fluids in the drilling fluid. A foreign substance (gas, liquid, or suspension) is added to the drilling fluid and continually maintained at a known and constant concentration. This substance becomes what I term a "reference fluid" and the method is termed "Referencing".

An ideal "reference fluid" is characterized by being non-indigenous to the system and will not react chemically or physically within the system in an unpredictable way. An idea "reference fluid" behaves similarly to the other fluids being measured in the extraction and measurement processes. Furthermore, an ideal "reference fluid" is able to be uniquely quantified along with the other components of interest in the detection process.

As the formation fluids and reference fluid arrive at the surface, they are extracted and measured. Utilizing an extraction and detection process which measures the formation fluid and reference fluid in proportion to their respective concentrations in the drilling fluid, the concentration of formation fluid in the drilling fluid is calculated as shown:

$$F_c = F_m \times \left(\frac{R_c}{R_m}\right)$$

Where:

Fc=Formation Fluid Concentration in the Drilling Fluid

Fm=Formation Fluid Measured

Rc=Reference Fluid Concentration in the Drilling Fluid

Rm=Reference Fluid Measured

A further advantage of the invention is the maintaining of a quality assurance of the measuring system. With the "reference fluid" always being present and detected, this verifies that the measurement system is operating properly.

Another feature of my invention is using the "reference fluid" as a "lag" tracer by momentarily changing its concentration in the drilling fluid. This makes it unnecessary to stop the drilling process or introduce solid items into the drillstring.

Other objects, aspects, features, and advantages of the invention will become apparent to those skilled in the art upon reference to the following detailed description of the invention and the accompanying drawings.

DESCRIPTION OF THE DRAWINGS

A preferred embodiment of the invention has been chosen for purposes of description and illustration and is shown herein in the accompanying drawings forming part of this specification, wherein.

Figure 1:
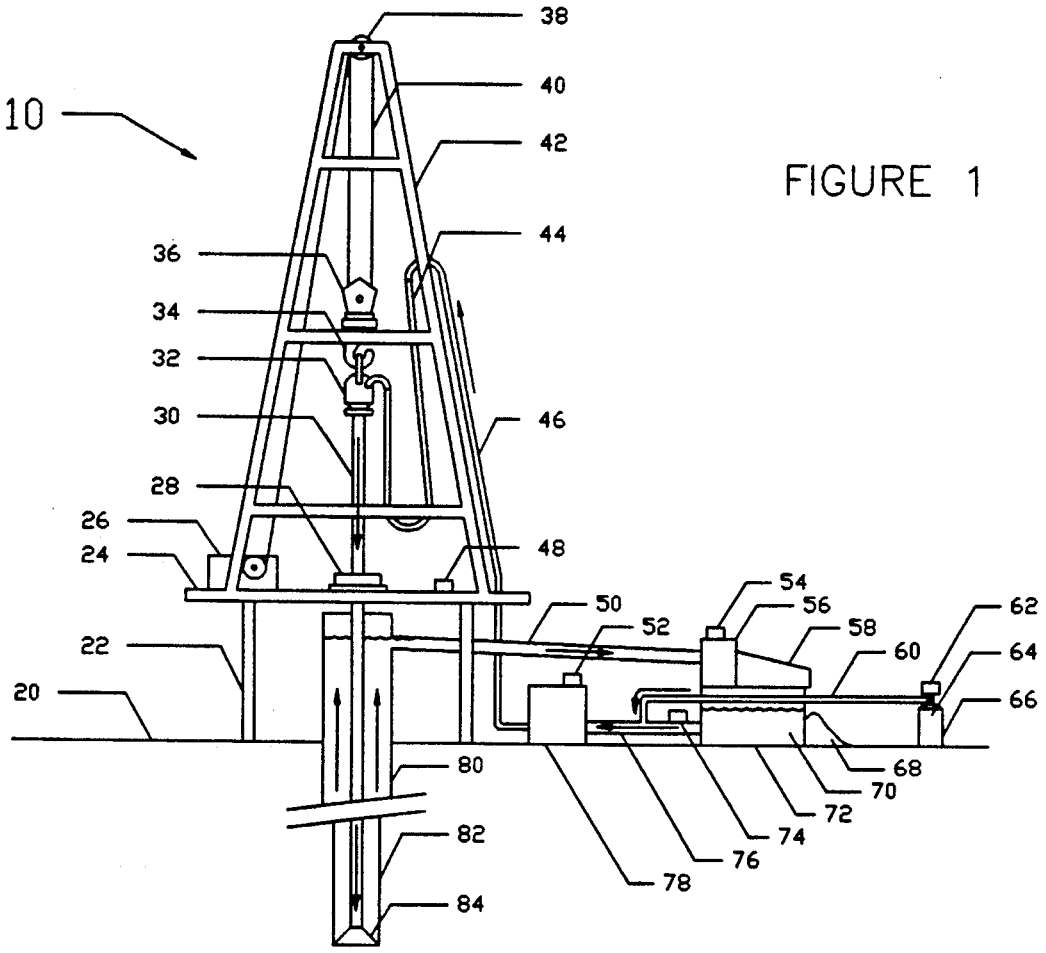
FIG. 1. is a diagrammatic representation of a well drilling operation and associated drilling fluid processing equipment in which the present invention is embodied.

| REFERENCE NUMERALS IN DRAWINGS | |
|---|---|
| 10 | Drilling Operation |
| 20 | Earth |
| 22 | Support Structure |
| 24 | Rig Floor |
| 26 | Motor |
| 28 | Rotary Bushing |
| 30 | Drillstring |
| 32 | Swivel |
| 34 | Hook |
| 36 | Traveling Block |
| 38 | Crown Block |
| 40 | Cable |
| 42 | Derrick |
| 44 | Hose |
| 46 | Standpipe |
| 48 | Depth Sensor |
| 50 | Return Line |
| 52 | Pump Rate Sensor |
| 54 | Return Mud Analyzer |
| 56 | Header Box |
| 58 | Screen |
| 60 | Reference Fluid Line |
| 62 | Reference Fluid Regulator |
| 64 | Reference Fluid |
| 66 | Reference Fluid Tank |
| 68 | Rock Cuttings |
| 70 | Drilling Fluid |
| 72 | Drilling Fluid Tank |
| 74 | Supply Mud Analyzer |
| 76 | Suction Line |
| 78 | Mud Pump |
| 80 | Surface Casing |
| 82 | Wellbore |
| 84 | Drill Bit |
| 110 | Well Log |

DESCRIPTION OF PREFERRED EMBODIMENT

A diagrammatic embodiment of the measuring method is shown in FIG. 1. The illustration shows how Reference Fluid (64) is applied to a typical Drilling Operation (10).

In a typical Drilling Operation (10), a Drill Bit (84) is caused to drill a Wellbore (82) into the Earth (20). Drilling Fluid (70) is utilized for several well known purposes including the removal and transporting of liberated Rock Cuttings (68) and formation fluids from the bit to the surface.

A drilling rig comprised of a Support Structure (22), Rig Floor (24), and Derrick (42) is placed over the Wellbore (82). On the drilling rig a Motor (26), Crown Block (38), Traveling Block (36), and Cable (40) provided a means to lift and lower the Hook (34), Swivel (32), Drillstring (30), and Drill Bit (84), in and out of the Surface Casing (8) and Wellbore (82). An internally splined Rotary Bushing (28) engages splines on the upper portion of the Drillstring (30) and has means to cause the Drillstring (30) and Drill Bit (84) to rotate.

A Mud Pump (78) draws Drilling Fluid (70) from the Drilling Fluid Tank (72) through the Suction Line (76) and pumps it through the Standpipe (46), Hose (44), Swivel (32), and Drillstring (30) to the Drill Bit (84). From openings in the Drill Bit (84) the Drilling Fluid (70) emerges and sweeps liberated rock cuttings, and formation fluids away from the cutting surface and carries them to the surface through the annular space between the Drillstring (30) and the Wellbore (82) and Surface Casing (80).

As the Drilling Fluid (70) emerges at the surface, it is directed through the Return Line (50) to the Header Box (56) and Screen (58). The Screen (58) sorts at least some of the Rock Cuttings (68) from the Drilling Fluid (70). The Drilling Fluid (70) is then returned to the Drilling Fluid Tank (72) for conditioning and recirculation.

A means to determine depth is provided by a Depth Sensor (48). A means to determine pump rate is provided by a Pump Rate Sensor (52). A means to analyze returning mud is provide by a Return Mud Analyzer (54). A means to analyze in-going mud is provide by Supply Mud Analyzer (74).

Using the Reference Fluid Regulator (62), a controlled amount of reference Fluid (64) from Reference Fluid Tank (66) through the Reference Fluid Line (60) is added to the Drilling Fluid (70) at the Suction Line (76).

Figure 2:
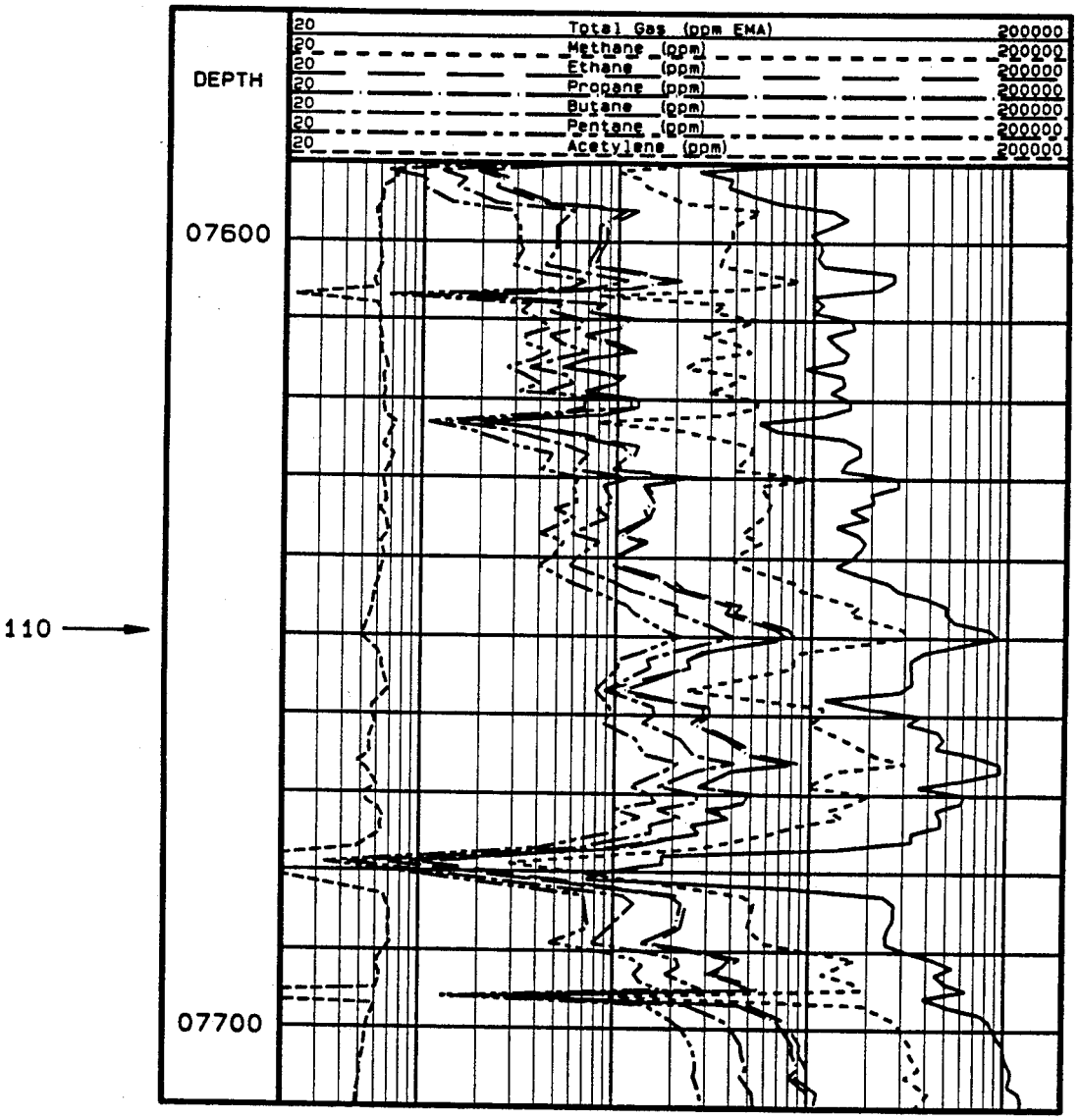
FIG. 2. is a graphic chart or well log showing surface measurements relating to an interval of wellbore including acetylene used as the "reference fluid" and certain light hydrocarbon formation fluids (C1–C5).

Now also referring to FIG. 2, a graphic chart or Well Log (110) is shown representing various surface gas measurements over an interval of wellbore. These measurements were made of low molecular weight hydrocarbon gases extracted at Return Mud Analyzer (54) using a gas chromatograph and "lagged" to the appropriate depth using Depth Sensor (48) and Pump Rate Sensor (52). Acetylene, used as the "reference fluid", is shown generally measuring in the 50–70 ppm range. These "ppm" measurements are "hydrocarbons-in-air after extraction from mud".

OPERATION

Referring to FIG. 1, the Reference Fluid (64) is added to the Drilling Fluid (70) at the Suction Line (76) at a controlled concentration regulated by the Reference Fluid Regulator (62) using continuous signals from the Pump Rate Sensor (52). Depending upon the life or dissipation rate of the Reference Fluid (64) within the system, data from an optional Supply Mud Analyzer (74) designed to measure recycled Reference Fluid (64) can also be used to maintain the concentration using the Reference Fluid Regulator (62).

As shown in FIG. 2, acetylene can be used as the reference fluid. This mixture of acetylene and Drilling Fluid (70) travels down through the Drillstring (30) to the Drill Bit (84) where rock cuttings and formation fluids are released and added to the mixture. This mixture then travels up the annulus between the Drillstring (30) and Wellbore (82) wall to the surface where a gas extraction device (a specific form of Return Mud Analyzer (54)) releases a portion of the acetylene and light hydrocarbons in proportion to their concentration from the drilling fluid. These gases are released into a chamber in the gas extractor and mixed with fresh air or carrier gas. This mixture of air and hydrocarbons is evacuated from the chamber by a vacuum pump to a nearby laboratory for analysis. A sample of this gas stream is analyzed using a gas chromatography and "lagged" to depth using Depth Sensor (48) and Pump Rate Sensor (52) resulting in data which can be graphed as shown in FIG. 2. My "Referencing" method allows for at a least three distinct modes of operation:

FIRST MODE–QUANTIFYING FORMATION FLUIDS IN DRILLING FLUIDS

Referring to FIG. 2 as an example, acetylene was used as a reference fluid in the drilling of this well. Acetylene was injected to maintain a concentration of 25 cc (at Standard Temperature and Pressure) per 1 barrel of drilling fluid. Note: The Reference Fluid (64) could have been be injected in the Return Line (50) instead of the Suction Line (76).

The gas measurements at 7650 show acetylene equal to 50 ppm, methane equal to 30,000 ppm. Assuming 1) that acetylene and methane are substantially non-interactive with the other mud components, 2) that the gas extractor extracts acetylene and methane in the same proportion to their respective concentrations in the mud; then:

$$\frac{F_c}{F_m} = \frac{R_c}{R_m} \text{ or } F_c = F_m \times \left(\frac{R_c}{R_m}\right)$$

Where:

Fc=Formation Fluid Concentration in the Drilling Fluid

Fm=Formation Fluid Measured

Rc=Reference Fluid Concentration in the Drilling Fluid

Rm=Reference Fluid Measured

Substituting into the above equation:

$$F_c = 30{,}000 \text{ ppm} \times \left(\frac{25 \text{ cc/bbl}}{50 \text{ ppm}}\right) = 15{,}000 \text{ cc/bbl}$$

By knowing pump rate from Pump Rate Sensor (52) and drilling rate using Depth Sensor (48) and the above concentration, the amount of methane released for each foot drill can be calculated. For this particular one foot interval, the pump rate was 4.5 bbl/minute and the drilling rate is 0.80 minutes per foot. The amount of methane in the drilling fluid during the drilling of one foot in the above example is: 15,000 cc/bbl * 4.5 bbl/min * 0.80 min/ft=54,000 cc/ft.

Assuming that the 54,000 cc of methane was liberated from the one foot hole volume (not produced from the opened formation or recycled as background), a porosity calculation can be made. Using standard pressure and temperature calculation, the 54,000 cc of methane at surface conditions was calculated to represents a volume of 250 cc of methane at formation pressure and temperature. With a bit diameter of 8.75", the borehole volume for one linear foot is 11,822 cubic centimeters. The porosity calculation in percent is 100 * 250 cc methane/11,822 cc of formation, or approximately 2.1% of the formation is methane.

Each gas can be calculated separately and the results summed to yield total gas saturated porosity.

It is important to consider the assumptions made in the discussion above. Acetylene is not an ideal reference fluid. The calculations above are based on ideal and simplified conditions to facilitate understanding. Under real conditions, acetylene reacts both chemically and physically to the drilling fluid. The drilling fluid is typically recycled repeatedly carrying with it a background of previously liberated hydrocarbons and reference fluid. Furthermore, it is assumed that acetylene extracts proportionally similar to methane and the other gases of interest. It may not. Compensation factors to account for actual dissimilarities can be introduced. Additional reference fluids can be added to the drilling fluid to handle specific groups of fluids. To increase precision, these factors should be considered and accounted for under real conditions.

SECOND MODE—QUALITY ASSURANCE

The drilling operation is interrupted many times during the course of drilling as well. For instance, drilling stops to add additional lengths of drill pipe to the Drillstring (30). Repairs and maintenance procedures occur frequently. Changes in the mud pump rate are made for various reasons. The sampling line from the gas extractor to the gas chromatograph can get frozen or broken.

My "Referencing" method provides a means of quality control by assuring that the system always has a calibrated "reference fluid" to measure. For example, referring to FIG. 2, the gas measurements centered at 7607 and 7622 are similar in character except for the acetylene reference fluid. The downward measurements at 7607 are due to a measurement taken shortly after the mud pumps began to recirculate drilling fluid through the gas extractor after stopping for a drillpipe connection. This same phenomena occurs at 7679, and 7696. However, at 7622 the acetylene reference fluid does not decrease along with the other gases. This shows an actual decrease in the hydrocarbon concentration in the mud not a fluctuation in the extractor efficiency.

Suppose, as another example, an agitator blade within the extractor wears down which reduces extractor efficiency. All measured gases would decrease. Since the reference gas is present and also decreases, the cause can be attributed to the measurement system instead of a change in formation gases.

THIRD MODE—METHOD FOR NON-DISRUPTIVE LAG MEASUREMENT

The third aspect of my invention uses the Reference Fluid Regulator (62) to momentarily increase the concentration of Reference Fluid (64) to be used as a lag tracer.

Previous lag measurement methods require the stopping of the drilling operation to introduce the lag tracer and usually the introduction of a solid container which holds the lag tracer. Since the Reference Fluid Line (60) is already connected to the system at the Suction Line (76), injection can take place without disrupting drilling operations or potentially damaging any equipment by introducing any solids.

SUMMARY, RAMIFICATIONS AND SCOPE

Accordingly, the reader will see how my method of adding a foreign substance (reference fluid) to the drilling fluid can be used to help evaluate oil and gas wells while drilling. It has been shown how "Referencing" provides a method:

(a) to measure formation fluids in drilling fluid without having a precisely measure gas extractor efficiency;

(b) to measure formation fluids in drilling fluid without having to precisely measure the amount or rate of drilling fluid being processed in the extractor;

(c) to measure formation fluids in drilling fluid without having to precisely measure the evacuation rate of the separated gases from the gas extractor;

(d) to use the results of gas-in-mud data with drill rate and pump rate to calculate gas-in-formation;

(e) of quality control to assure that the gas extraction and detection system is properly functioning;

(f) introduce a lag tracer to the drilling fluid without having to stop drilling operations;

(g) to introduce a lag tracer to the drilling fluid without damaging downhole tools.

Although the description above contains many specificities, these should not be construed as limiting the scope of the invention but as merely providing illustrations, of some of the presently preferred embodiments of this invention. For example, a liquid such as an alcohol might better be used as a reference fluid to measure other formation liquids using a detecting means other then gas chromatography, etc.

Thus the scope of the invention should be determined by the appended claims and their legal equivalents, rather than by the examples given.

I claim:

1. A method of measuring the concentrations of a plurality of formation fluids in the drilling fluid exiting a borehole in a drilling operation comprising the steps of:

a. adding and maintaining a controlled concentration of a select foreign substance in said drilling fluid;

b. extracting and measuring at least a portion of a specific formation fluid and at least a portion of said select foreign substance in proportion to their respective concentration in said drilling fluid;

c. determining the concentration of said specific formation fluid by multiplying the measured amount of extracted said specific formation fluid by said controlled concentration of said select foreign substance divided by the measured amount of extracted said select foreign substance.

2. The method as described in claim 1 wherein said select foreign substance is acetylene.

3. The method as described in claim 1 wherein more than one said select foreign substance can be used at the same time.

4. The method as described in claim 1 wherein compensation factors are applied as needed to compensate for different extraction efficiencies of said specific formation fluid and of said select foreign substance from said drilling fluid.

5. The method as described in claim 1 wherein compensation factors are applied as needed to compensate for changes in said controlled concentration of said select foreign substance in said drilling fluid from the time of injection of said select foreign substance to the time of extraction of said select foreign substance.

6. The method as described in claim 1 whereby a controlled increase in the said controlled concentration of said select foreign substance provides a means to measure lag.

7. The method of claim 1 including identifying over time the presence of said select foreign fluid in an amount consistent with said controlled concentration showing that said measuring system is performing.

8. The method of claim 1 wherein said adding and maintaining step includes adding and maintaining a constant concentration of said select foreign substance.

9. A method of measuring the concentration of a plurality of formation fluids in the drilling fluids exiting a borehole in a drilling operation comprising the steps of:

a. adding and maintaining a controlled concentration of a select foreign substance in said drilling fluid, said select foreign substance having a known behavior in a drilling operation relative to a specific formation fluid;

b. extracting and measuring at least a portion of said specific formation fluid and at least a portion of said select foreign substance in proportion to their respective concentration in said drilling fluid;

c. determining the concentration of said specific formation fluid by multiplying the measured amount of extracted said specific formation fluid by said controlled concentration of said select foreign substance divided by the measured amount of extracted said select foreign substance.

10. The method as described in claim 9 wherein said select foreign substance is acetylene.

11. The method as described in claim 9 wherein more than one said select foreign substance can be used at the same time.

12. The method as described in claim 9 wherein compensation factors are applied as needed to compensate for different extraction efficiencies of said specific formation fluid and of said select foreign substance from said drilling fluid.

13. The method as described in claim 9 wherein compensation factors are applied as needed to compensate for changes in said controlled concentration of said select foreign substance in said drilling fluid from the time of injection of said select foreign substance to the time of extraction of said select foreign substance.

14. The method as described in claim 9 whereby a controlled increase in the said controlled concentration of said select foreign substance provides a means to measure lag.

15. The method of claim 9 including identifying over time the presence of said select foreign fluid in an amount consistent with said controlled concentration showing that said measuring system is performing.

16. The method of claim 9 wherein said adding and maintaining step includes adding and maintaining a constant concentration of said select foreign substance.

17. A method for continuous quality assurance that extraction and measurement processes for fluids in the drilling fluid exiting a bore hole in a drilling operation are operating comprising the steps of:

a. adding and continuously maintaining a controlled concentration of a select foreign substance in said drilling fluid;

b. extracting and measuring at least a portion of said select foreign fluid; and c. identifying over time the presence of said select foreign fluid in an amount consistent with said controlled concentration showing that said extraction and measuring processes are operating.

18. The method of claim 17 wherein said adding and maintaining step includes adding and maintaining a constant concentration of said select foreign substance.

19. The method of claim 17 including the step of providing a controlled increase in the controlled concentration of said select foreign substance for measuring lag.

* * * * *